United States Patent [19]

Zwicker

[11] Patent Number: 4,538,985

[45] Date of Patent: Sep. 3, 1985

[54] VAPORIZATION BURNER

[75] Inventor: Wolfgang Zwicker, Krailling, Fed. Rep. of Germany

[73] Assignee: Webasto-Werk W. Baier GmbH & Co., Fed. Rep. of Germany

[21] Appl. No.: 528,654

[22] Filed: Sep. 1, 1983

[30] Foreign Application Priority Data

Sep. 8, 1982 [DE] Fed. Rep. of Germany ..... 3233319

[51] Int. Cl.[3] ..... F23Q 7/08

[52] U.S. Cl. ..... 431/262; 431/261; 126/116 R; 219/270

[58] Field of Search ..... 431/261, 262, 266, 328, 431/208; 237/12.3 C; 219/270, 261, 267; 261/100, 101; 361/264, 266; 126/116 R

[56] References Cited

U.S. PATENT DOCUMENTS

| | | | |
|---|---|---|---|
| 1,956,240 | 4/1934 | Ludwig | 219/270 |
| 2,239,175 | 4/1941 | Unser | 431/262 |
| 2,603,281 | 7/1952 | Frankland | 431/262 X |
| 3,024,836 | 3/1962 | Bello | 431/328 X |
| 3,073,379 | 1/1963 | Martin | 431/328 X |
| 3,159,201 | 12/1964 | Hottenroth et al. | 431/261 X |
| 3,191,659 | 6/1965 | Weiss | 431/262 X |
| 3,617,697 | 11/1971 | Kahn | 219/270 X |
| 3,737,625 | 6/1973 | Martin | 219/270 X |
| 3,849,055 | 11/1974 | Stanley et al. | 431/262 X |
| 4,365,952 | 12/1982 | Ohmukai et al. | 431/208 |
| 4,450,681 | 5/1984 | Sato et al. | 431/262 X |

FOREIGN PATENT DOCUMENTS

| | | | |
|---|---|---|---|
| 2149786 | 4/1972 | Fed. Rep. of Germany | 431/262 |

*Primary Examiner*—Randall L. Green

*Attorney, Agent, or Firm*—Sixbey, Friedman & Leedom

[57] ABSTRACT

A vaporization burner operated by means of liquid fuel for heaters, especially motor vehicle heaters. The burner has a combustion chamber, into which combustion air can be introduced in a turbulent manner under pressure. The burner also has a vaporization body made of an absorbent material that is supplied with fuel and has an essentially flat evaporation surface that faces into the combustion chamber for vaporizing the supplied fuel prior to mixing with the combustion air. Situated in the combustion chamber is an electric ignition device for igniting an initial flame. In accordance with preferred embodiments, the ignition device is an essentially flat glow-type heating element which is disposed in a plane that is adjacent and parallel to the evaporation surface of the vaporization body.

22 Claims, 10 Drawing Figures

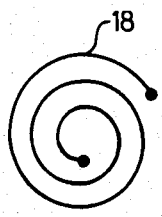
FIG. 2
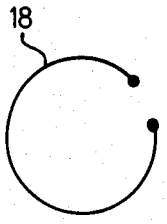
FIG. 3
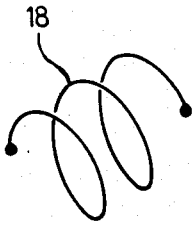
FIG. 4
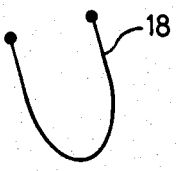
FIG. 5
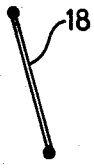
FIG. 6
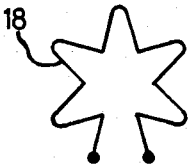
FIG. 7
FIG. 8
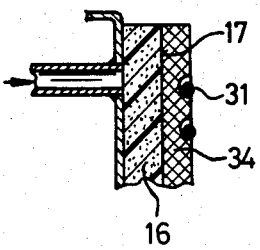
FIG. 9
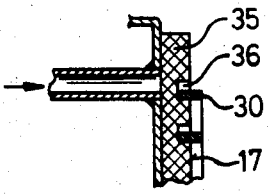
FIG. 10
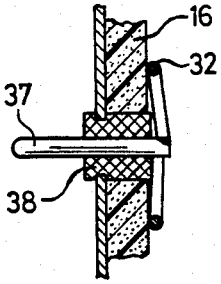

VAPORIZATION BURNER

BACKGROUND AND SUMMARY OF THE INVENTION

This invention relates to a vaporization burner operated by means of liquid fuel for heaters, especially motor vehicle heaters, having a combustion chamber into which combustion air can be introduced in a turbulent manner under pressure, having a vaporization body made of an absorbent material that is filled with fuel and has an essentially flat evaporation surface, for the vaporization of the supplied fuel before mixing with the combustion air, as well as having an electric ignition device for the ignition of the initial flame.

In the known vaporization burners of this type, a spiral or rod-shaped glow plug is used as the ignition device and projects laterally into the combustion chamber at a point that is located at a distance in front of the evaporation surface. Initially, the ignition device provides heat that is required to bring the fuel to its vaporization temperature. However, because of its construction, the glow plug requires a lot of space in the combustion chamber, which, as a rule, is relatively small. The glow plug, by protruding into the combustion chamber, sometimes impairs the continuing combustion process considerably, especially because it disturbs the flow in the combustion chamber. Furthermore, only a fraction of the heat energy produced by the electrical current in the ignition device is supplied to the evaporation surface. In the case of rod-shaped spark plugs, it is also difficult to reach the required surface temperature, while spiral spark plugs tend to lead to a coking of the spirals with resulting short circuits and ground fault circuits.

This invention is based on the objective of creating a vaporization burner which has an especially simple construction and results in improved efficiency, but which does not disturb the combustion in the combustion chamber.

According to preferred embodiments of the invention, this objective is achieved by the fact that an essentially flat glowing heating element is provided which is disposed in a plane that is parallel to the evaporation surface directly in front of or in the vaporization body.

On the basis of the embodiments according to the invention, the heat supply required at the start is targeted and takes place where it is needed for the generation of the initial flame; the turbulence of the fuel in the combustion chamber is virtually unimpaired; the danger of coking can be largely eliminated; and the current consumption is decreased because of the better utilization of heat.

A constructively especially simple solution can be obtained when the glowing heating element consists of a heater plug filament formed into a flat geometrical shape.

In a further development of the invention, the vaporization body and the glowing heating element are supported on a common support which expediently is detachably connected with the other parts of the burner. This not only decreases the constructive expenditures, but also permits, in an especially convenient manner, a simultaneous exchange of the vaporization body and the glowing heating element. In this case, the vaporization body and the glowing heating element can be exchanged together with the carrier.

The glowing heating element may be developed as a mechanical mounting for the vaporization body. Vice versa, the vaporization body itself may be designed as the carrier for the glowing heating element. The common support or the vaporization body itself may be developed as a removable, lid-type, front-side end of the combustion chamber. In addition to the exchange of the vaporization body and the glowing heating element, this also permits an easy cleaning of the combustion chamber. The glowing heating element may sit on the front surface of the vaporization body facing the combustion chamber or may be imbedded in open grooves provided there. Electrical connections for the glowing heating element may simply be led through the vaporization body and may be expediently formed as plug connection elements. By a distribution of the glowing heating element, for example, by using element wires with large distances between turns, essentially over the whole evaporation surface of the vaporization body, the coking danger can be reduced by a large-surface burning-away of combustion residues.

These and further objects, features and advantages of the present invention will become more obvious from the following description when taken in connection with the accompanying drawings which show, for purposes of illustration only, several embodiments in accordance with the present invention.

BRIEF DESCRIPTION OF THE DRAWINGS

FIGS. 2–7 show various embodiments of a glow-type heating element in accordance with the invention;

FIG. 8 is a partial section through an embodiment having a heater plug filament placed on a vaporization fleece in a guide formed by ceramic crosspieces;

FIG. 9 is a partial section corresponding to FIG. 8, for an embodiment where a heater plug filament is inserted into grooves within a ceramic vaporization body; and FIG. 10 is a partial section showing a connection of the glowing heating element developed as a plug connection.

DETAILED DESCRIPTION OF THE PREFERRED EMBODIMENTS

Figure 1:
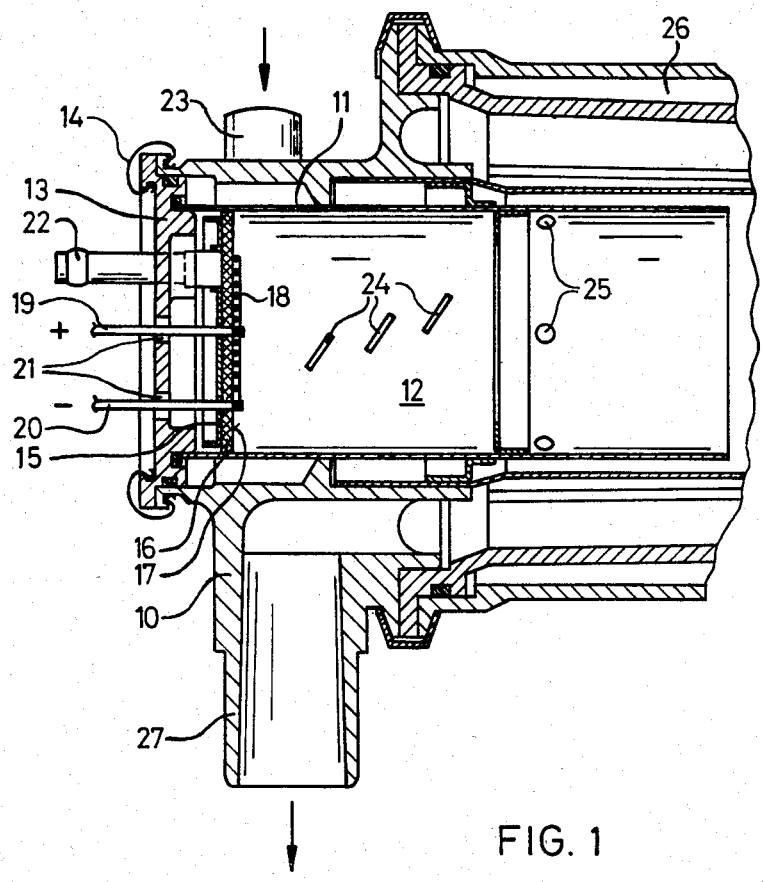
FIG. 1 is a longitudinal, partial-sectional view in the vicinity of the combustion chamber of a motor vehicle heater having a vaporization burner constructed according to the present invention.

The motor vehicle heater according to FIG. 1 has a burner head 10. A combustion pipe 11, which forms the border of a combustion chamber 12, is inserted into burner head 10. The front end of burner head 10 (rear end of the combustion chamber) is on the left in FIG. 1, and is closed by means of a removable lid 13. The lid 13 is detachably connected with the burner head via a spring ring or several spring clips 14 distributed around its periphery. A carrier 15, for a vaporization body 16, is supported on the lid 13. The vaporization body 16, such as an absorbent body formed of a heat-resistant porous material like a fleece or porous ceramic layer, is mounted on the carrier 15. A glow-type heating element 18, consisting of heater plug filament and forming a planar geometrical shape, is located on the side of the flat evaporation surface 17 of the fleece 16 that faces the combustion chamber 12. The heating element 18 is supplied with electrical energy via connections 19, 20. The connections 19, 20 extend, in an axial direction, through the vaporization fleece 16, the fleece carrier 15 and the lid 13, in which case corresponding passages 21, made of ceramic or molded glass, are provided in the lid. A pipe 22, extending through the lid 13, leads into the fleece carrier 15, and is the means by which a liquid fuel, such as Diesel fuel, heating oil or gasoline, is supplied to the vaporization body 16.

Combustion air is fed into the burner head 10 under pressure via a connection 23. The combustion air enters the combustion chamber 12 via twisted slots 24 so that a turbulent flow is generated in the combustion chamber, which ensures an even mixing of the air with the fuel evaporating from the surface 17 of the vaporization body. In order to generate an initial flame, the heating element 18, at the time of burner ignition, is supplied with electrical energy via connections 19, 20. The heat generated by the electrical current in the heat element is concentrated at a location within the combustion chamber where the flame must be ignited, so that relatively little heat is lost at the burner head 10 in the process. Secondary air enters via the openings 25. A heat exchanger and an exhaust-gas connection are indicated at 26 and 27, respectively.

The shape of the glow-type heating element 18 may be selected according to the constructive situation in the combustion chamber and the heater plug material used. As exemplary embodiments, FIGS. 2 to 7 show spiral-shaped, ring-shaped, helical, hook-shaped, rod-shaped and star-shaped glow-type heating elements. For reasons of mechanical stability, the heating elements must expediently have cross sections of at least about 1 $mm^2$. In order to avoid electrical energy consumption that is too high, a material is advantageously provided which, in connection with the required resistance to temperature (about 1200° C.), has a relatively high specific resistance. Among other things, heater plug filaments made of CrNi- and CrAl-alloys have been found suitable. For the rod-shaped construction according to FIG. 6, appropriate carbon compounds may, also, be utilized. The shape of the cross section of the heater plug filament may basically be arbitrary. When high stability is important, a filament 30 (FIG. 9), having a rectangular cross section, may be used; in other cases, filaments 31, 32 (FIGS. 8 and 10), having a circular cross section, are utilized, as a rule.

As apparent from FIG. 1, the present invention results in savings related to the work processes for inserting conventional glow or spark plugs. Especially, the burner head 10 does not require the normal plug thread. An additional sealed point between the spark plug and the combustion chamber is also not required. The lid 13 that closes the rear end of the combustion chamber has a dual purpose, as the carrier of the vaporization body 16 and the support for the heating element 18. The vaporization body 16, as well as the heating element 18, as parts subject to wear, are replaced together.

The vaporization body 16 may be a textile fleece. On its evaporation surface 17, the filament 31 of the heating element 18 may be guided by means of small ceramic crosspieces 34, as shown in FIG. 8. Alternatively, if a temperature-resistant, porous body, especially a ceramic fleece 35 (FIG. 9), is used, a filament 30 may be inserted into open grooves 36 at the evaporation surface 17 thereof. In the case of such an integration of the glow-type heating element 18 into the fleece, the heating element may, at the same time, also be the mechanical mounting for the vaporization body 16.

In any case, as can be easily recognized from the figures, the heating element does not impair the turbulent flow in the combustion chamber 12. Furthermore, zones that tend to coke are avoided. In addition, the space available in the area of the rear wall of the combustion chamber 12, as a rule, is so large that even glowing spirals operating with 24 V power supplies may be housed without difficulties. The electrical connections of the heating element 18 may, as shown in detail in FIG. 10, be formed as plug connection elements 37, only one of which is shown (of a flat-plug, round-plug or similar construction), and may extend to the exterior of the burner heat 10 via insulated passages 38. In this manner, the heating element and its electrical connection act as a mechanical fastening means mounting the evaporation body 16 to carrier 15 and, in turn, to the lid and burner.

According to a modified embodiment (not shown in detail), the lid 13 may be made of a ceramic material, and thus may itself be formed with electrically insulating passages for the connections 19, 20 or corresponding plug connection elements 37 may be utilized.

While I have shown and described various embodiments in accordance with the present invention, it is understood that the same is not limited thereto, but is susceptible of numerous changes and modifications as known to those skilled in the art, and I, therefore, do not wish to be limited to the details shown and described herein, but intend to cover all such changes and modifications as are encompassed by the scope of the appended claims.

I claim:

1. A vaporization burner for liquid fuel heaters that is operable in any orientation, especially motor vehicle heaters, comprising a combustion chamber having combustion air intake means for introducing air into the combustion chamber in a turbulent manner, a vaporization body made of a fuel absorbent material, said vaporization body being connected to a means for supplying liquid fuel thereto and having an essentially flat evaporation surface facing into said combustion chamber, for the vaporization of fuel supplied thereto for mixing with the combustion air, and an electric ignition device for igniting an initial flame, wherein the ignition device is a glow-type heating element which is disposed on the evaporation surface, wherein the vaporization body and the heating element are carried on a carrier that is mounted to the burner, said vaporization body and heating element being carried in such a manner that the vaporization body and heating element are replaceable as a unit.

2. A vaporization burner according to claim 1, wherein the heating element comprises a heater plug filament that is formed into a flat geometrical shape.

3. A vaporization burner according to claim 2, wherein said carrier is detachably mounted to the burner.

4. A vaporization burner according to claim 3, wherein the carrier for the vaporization burner is formed as a removable, lid-type end of the combustion chamber.

5. A vaporization burner according to claim 3, wherein the heating element is situated in open grooves formed in the vaporization surface of the vaporization body.

6. A vaporization burner according to claim 2, wherein the heating element is situated in open grooves formed in the vaporization surface of the vaporization body.

7. A vaporization burner according to claim 2, wherein the heating element is distributed over substantially the entirety of said evaporation surface of the vaporization body.

8. A vaporization burner according to claim 3 wherein the carrier is constructed to enable replacement thereof as a unit with the vaporization body and heating element.

9. A vaporization burner according to claim 1, wherein said carrier is detachably mounted to the burner.

10. A vaporization burner according to claim 9 wherein the carrier is constructed to enable replacement thereof as a unit with the vaporization body and heating element.

11. A vaporization burner according to claim 1, wherein the heating element mechanically fastens the vaporization body to the burner.

12. A vaporization burner according to claim 1, wherein the vaporization body carries the heating element.

13. A vaporization burner according to claim 12, wherein the heating element is situated in open grooves formed in the vaporization surface of the vaporization body.

14. A vaporization burner according to claim 12, wherein electrical connections for the heating element extend through the vaporization body.

15. A vaporization burner according to claim 14, wherein electrical connections are developed as plug connection elements.

16. A vaporization burner according to claim 12, wherein the heating element is distributed over substantially the entirety of said evaporation surface of the vaporization body.

17. A vaporization burner according to claim 1, wherein the vaporization body is carried by a removable, lid-type end of the combustion chamber.

18. A vaporization burner according to claim 1, wherein the heating element is situated in open grooves formed in the vaporization surface of the vaporization body.

19. A vaporization burner according to claim 18, wherein electrical connections for the heating element extend through the vaporization body.

20. A vaporization burner according to claim 19, wherein electrical connections are developed as plug connection elements.

21. A vaporization burner according to claim 18, wherein the heating element is distributed over substantially the entirety of said evaporation surface of the vaporization body.

22. A vaporization burner according to claim 1, wherein the heating element is distributed over substantially the entirety of said evaporation surface of the vaporization body.

* * * * *